US005291673A

United States Patent [19]

Hamburg et al.

[11] Patent Number: 5,291,673

[45] Date of Patent: Mar. 8, 1994

[54] OXYGEN SENSOR SYSTEM WITH SIGNAL CORRECTION

[75] Inventors: Douglas R. Hamburg, Bloomfield Hills; Jeffrey A. Cook, Dearborn; Wayne J. Johnson, Dearborn Heights; Louis J. Sherry, Taylor, all of Mich.

[73] Assignee: Ford Motor Company, Dearborn, Mich.

[21] Appl. No.: 994,013

[22] Filed: Dec. 21, 1992

[51] Int. Cl.[5] ..... F02D 41/14

[52] U.S. Cl. ..... 60/274; 60/276; 123/697

[58] Field of Search ..... 123/697, 689, 688, 690, 123/691, 676, 488; 60/274, 276

[56] References Cited

U.S. PATENT DOCUMENTS

| | | | |
|---|---|---|---|
| 3,868,846 | 3/1975 | Kushida et al. | 123/697 |
| 3,948,081 | 4/1976 | Wessel et al. | 123/697 |
| 4,319,451 | 3/1982 | Tajima et al. | 60/274 |
| 4,471,648 | 9/1984 | Uchida et al. | 123/697 |
| 4,685,290 | 8/1987 | Kamiya et al. | 60/274 |
| 4,707,984 | 11/1987 | Katsumo et al. | 60/274 |
| 4,708,777 | 11/1987 | Kuraoka | 204/1 T |
| 4,719,895 | 1/1988 | Mieno et al. | 123/689 |
| 4,753,204 | 6/1988 | Kojima | 123/697 |
| 4,773,376 | 9/1988 | Uchikawa et al. | 123/697 |
| 4,889,098 | 12/1989 | Suzuki et al. | 123/489 |
| 4,911,130 | 3/1990 | Takahashi et al. | 123/489 |
| 4,938,196 | 7/1990 | Hoshi et al. | 123/489 |
| 4,947,819 | 8/1990 | Takahashi et al. | 123/489 |
| 4,953,351 | 9/1990 | Motz et al. | 60/285 |
| 4,964,272 | 10/1990 | Kayanuma | 60/274 |
| 5,111,792 | 5/1992 | Nagai et al. | 123/697 |
| 5,119,629 | 6/1992 | Kume et al. | 60/274 |
| 5,148,795 | 9/1992 | Nagai et al. | 123/697 |
| 5,158,063 | 10/1992 | Hosoda et al. | 123/676 |
| 5,159,810 | 11/1992 | Grutter et al. | 60/274 |
| 5,167,120 | 12/1992 | Junginger et al. | 123/697 |
| 5,172,677 | 12/1992 | Suzuki | 123/697 |
| 5,193,339 | 3/1993 | Furaya | 60/274 |

FOREIGN PATENT DOCUMENTS

| | | | |
|---|---|---|---|
| 0227832 | 9/1989 | Japan | 123/697 |
| 0232140 | 9/1989 | Japan | 123/697 |
| 0232143 | 9/1989 | Japan | 123/697 |
| 0277644 | 11/1989 | Japan | 123/697 |
| 0145954 | 6/1990 | Japan | 123/689 |
| 0204647 | 8/1990 | Japan | 123/697 |

*Primary Examiner*—Tony M. Argenbright
*Assistant Examiner*—Thomas Moulis
*Attorney, Agent, or Firm*—Peter Abolins; Roger L. May

[57] ABSTRACT

An exhaust gas sensor system for use with an internal combustion engine having an exhaust conduit and a catalytic converter. The system includes an exhaust gas oxygen sensor, temperature sensor, and signal conditioner. The exhaust gas oxygen sensor is positioned on the conduit, downstream of the catalytic converter, and provides an oxygen level signal. The temperature sensor is also downstream of the catalytic converter, sensing the temperature of the oxygen sensor. A signal conditioner receives outputs from both the exhaust gas oxygen sensor and the temperature sensor. The oxygen level signal from the oxygen sensor is adjusted, according to the temperature sensed by the temperature sensor, to provide a more accurate oxygen level signal to other components of the engine such as, for example, an air-fuel controller.

9 Claims, 9 Drawing Sheets

26

22
34
20
24
30
70
36
38
32
44
46
28
40
CONTROL
ASSEMBLY

STOICHIDMETRY
A/F FEEDBACK SIGNAL
HEGO SIGNAL

AVERAGE A/F
A/FEEDBACK SIGNAL
HEGO SIGNAL

OXYGEN SENSOR SYSTEM WITH SIGNAL CORRECTION

RELATED APPLICATION

The present patent application is related to U.S. patent application Ser. No. 995,253, entitled Multiple Oxygen Sensor System for an Engine, filed on Dec. 21, 1992 and has the same inventors as the present application. The disclosure of this related application is incorporated herein by reference.

BACKGROUND OF THE INVENTION

The present invention relates generally to electronic engine controls and to feedback controls for engine operation using exhaust gas oxygen sensors. More particularly, the present invention relates to a sensor system having an exhaust gas oxygen ("EGO") sensor interconnected to an exhaust system downstream of a catalytic converter.

Many automotive vehicles include an internal combustion engine and an exhaust system that provides a conduit for heated combustion gas to move away from the engine. The temperature of the exhaust gas ranges from ambient temperature, when the engine has not been in operation recently, to 400° Celsius or more.

A typical exhaust system may include an EGO sensor assembly and a catalytic converter. The catalytic converter promotes the conversion of hydrocarbons, carbon monoxide, and oxides of nitrogen into less noxious compounds. An EGO sensor is often placed "upstream" of the catalytic converter. The terms "downstream" and "upstream" are relative terms used to denote relative positions along the exhaust conduit, or pipe, of the vehicle. The term "downstream" refers to positions along the exhaust conduit that are reached by a particle in the exhaust gas later in time than positions that are "upstream."

Many air-fuel control systems in presently available vehicles, with the EGO sensor located upstream of the catalyst, provide an air-fuel feedback signal for a closed-loop air-fuel delivery system in the engine. The upstream EGO sensor, however, can be "poisoned" by certain compounds, such as lead or silicone. Such components may be present in the raw exhaust gas. This may occur, for example, if a motorist improperly uses "leaded" gasoline in an engine designed only for "unleaded" gasoline. Such poisoning may render the EGO sensor ineffective in accurately ascertaining the level of the oxygen concentration in the exhaust gas.

Also, the output characteristics of an upstream EGO sensor may change over time. Moreover, under some operating conditions, the upstream EGO sensor may be unable to bring the exhaust gas flowing nearby it to a substantial equilibrium. Such conditions may be dependent on, for example, the engine load and cylinder-to-cylinder air-fuel maldistribution in the engine. As a result, the EGO sensor will exhibit "offset errors."

Further, many EGO sensors only operate effectively if the temperature of the sensor is within a particular range. The temperature of the sensor is, of course, influenced by the temperature of the adjacent exhaust gas. To assist an EGO sensor to make accurate measurements over a wide range of exhaust gas temperatures, the EGO sensor assembly often includes an electric heater physically adjacent, or near, the EGO sensor. Such a heated exhaust gas oxygen sensor is a type of EGO sensor and is often referred to as a HEGO sensor.

When actuated, the heater warms the sensor to enable it make more accurate measurements and, thus, reduce the effect of temperature variations of the exhaust gas passing through the exhaust pipe of the vehicle.

Prior art systems exist for controlling the air-fuel ratio of an internal combustion engine. For example, U.S. Pat. No. 4,708,777, issued to Kuraoka, discloses an air/fuel ratio feedback control system that is responsive to an EGO sensor. The EGO sensor is maintained at a predetermined temperature by feedback from the sensor heater.

Thus, some prior systems have attempted to maintain a constant air-fuel ratio operating point, which is independent of the exhaust gas temperature. In addition to maintaining a constant, closed-loop air-fuel ratio operating point independent of exhaust gas temperature or engine operating conditions, however, it is also desirable to have an EGO sensor that may more accurately detect oxygen levels, regardless of the exhaust gas constituencies and poisoning effects. In this way, the feedback control enables the controller to more precisely regulate the operation of the internal combustion engine.

Further, since the EGO sensor assemblies are generally mass-produced and put on many cars, even a small savings on one part of the assembly can accumulate to a substantial annual savings. Thus, an EGO sensor system should not have an excessive number of parts nor high manufacturing costs. Moreover, it is important that the sensor assembly be reliable.

SUMMARY OF THE INVENTION

The present invention is an EGO sensor system for internal combustion engine. The engine has an exhaust conduit and a catalytic converter on the conduit. The system includes an oxygen sensor, temperature sensor, and signal conditioner.

The oxygen sensor is located downstream of the catalytic converter. The oxygen sensor detects the level of oxygen in the exhaust gas and provides an oxygen level signal. The temperature sensor detects the temperature near the sensor and provides a temperature signal. The signal conditioner receives signals from both the oxygen sensor and temperature sensor. The oxygen level signal is then adjusted by the signal conditioner in accordance with the temperature signal. In this way, the effects of varying exhaust gas temperatures do not substantially affect the performance of the oxygen sensor.

In another embodiment, the present invention is a method utilized to provide an oxygen level signal. The method includes the steps of detecting both the oxygen level and the temperature at the sensor location. The oxygen level measured is then adjusted, as a function of the temperature detected, to provide the oxygen level signal.

BRIEF DESCRIPTION OF THE DRAWINGS

The preferred embodiments of the present invention are described herein with reference to the drawings wherein.

DETAILED DESCRIPTION OF PREFERRED EMBODIMENTS

Figure 1:
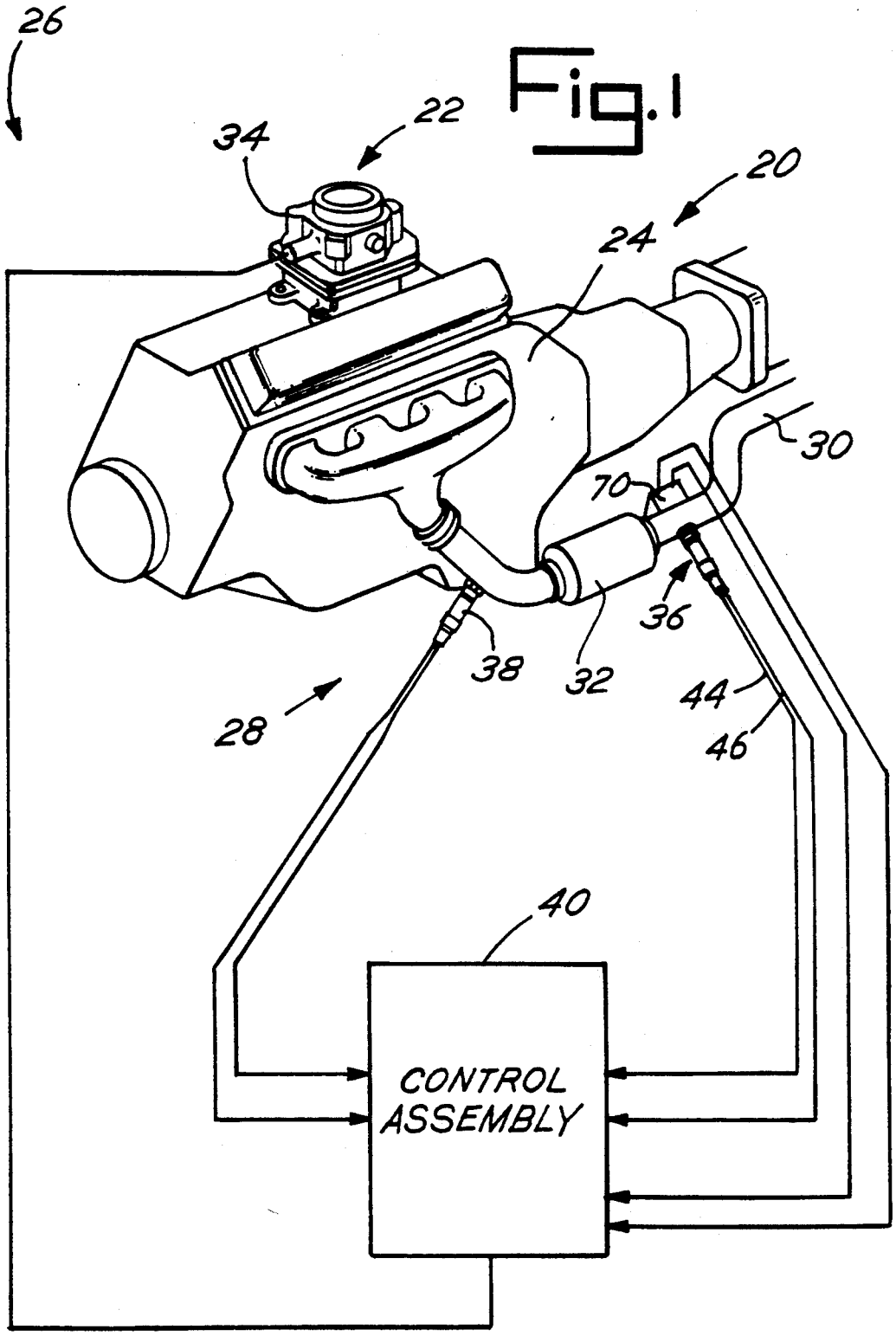
FIG. 1 is a diagram of an oxygen sensor system interconnected to the exhaust system of an internal combustion engine.
Figure 2:
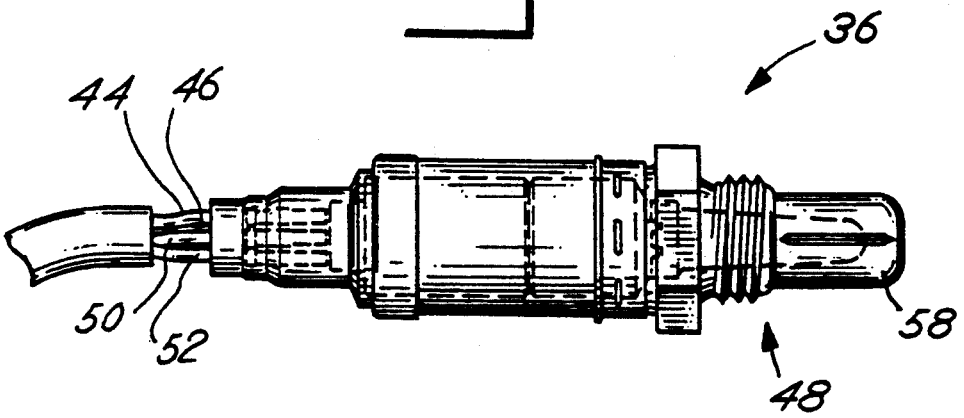
FIG. 2 is a side view of the HEGO sensor assembly shown in FIG. 1.
Figure 3:
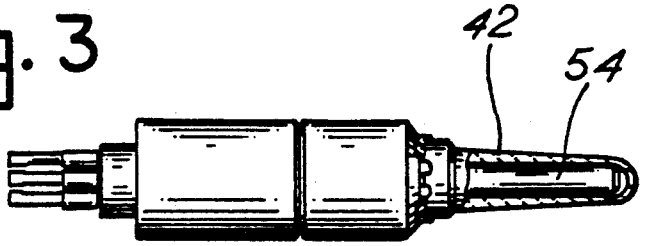
FIG. 3 is a partial cross-sectional view of the HEGO sensor assembly shown in FIG. 2.

Referring to FIGS. 1-15, a preferred embodiment of the present invention is shown as an oxygen sensor system with signal correction 20 for use with an internal combustion engine 22. As shown in FIG. 1, the engine 22 includes an engine block 24 having internal cylinders (not shown) in which combustion takes place, an air-fuel delivery system 26, and an exhaust system 28.

The exhaust system 28 includes an exhaust pipe or conduit 30, to carry exhaust gas away from the engine 22, and a three-way catalytic converter 32. In the one exemplary embodiment shown, the air-fuel delivery system 26 includes an air-fuel distributor 34 and the oxygen sensor system 20. The sensor system 20 includes a downstream HEGO sensor 36, which is downstream both the engine 22 and the catalytic converter 32, an upstream HEGO sensor 38, which is upstream of the catalytic converter 32 (but, of course, downstream of the engine 22), and a HEGO control assembly 40. EGO sensors could, of course, be used in some applications in lieu of the HEGO sensors 36, 38. The air-fuel distributor 34 receives a signal from the control assembly 40 and physically provides a mixture of air and fuel to the engine cylinders.

Each of the HEGO sensors 36, 38 includes similar components, and the downstream sensor 36 is explained in order to illustrate the basic operation of both. The sensor 36 includes a sensing tip 42, interconnected to first and second output leads 44, 46, and a heater 48, also having first and second leads 50, 52. See FIGS. 1-3. The leads 44, 46 deliver an oxygen level signal to the control assembly 40 (representing the oxygen concentration in the exhaust gas adjacent the sensing tip 42).

The first and second leads 50, 52 of the heater 48 are interconnected to a resistive heating element 54. The sensing tip 42 is encased in a protective canister 58, and the assembly is screwed into the exhaust pipe 30. The sensing tip 42 contacts gas flowing through the exhaust pipe 30, effectively measures the level of oxygen in the exhaust gas, and provides an oxygen level signal, in the form of a voltage differential, along the output leads 44, 46. The tip 42 is typically composed of zirconia dioxide $ZrO_2$.

The control assembly 40 receives the oxygen level signals from the upstream and downstream EGO sensors 36, 38. In response, the assembly 40 provides an air-fuel mixture control signal to the air-fuel distributor 34, which, in turn, influences the richness or leanness of the air-fuel mixture supplied to the cylinders of the engine 22.

The downstream HEGO sensor 36 acts as a feedback unit. The sensor 36 is effectively "protected" by the catalytic converter 32: the exhaust gases are brought to substantially chemical equilibrium by the catalytic converter 32 before reaching the downstream sensor 36 (and the catalytic converter 32 prevents contaminants, such as lead, from reaching the downstream sensor 36). As a result, air-fuel offset errors are reduced. Thus, the sensor 36 is able to bring the chemicals in the exhaust gas near it into equilibrium, and the downstream sensor 36 provides a signal more precisely representing the oxygen level concentration in the exhaust gas.

The upstream sensor 38, in contrast, provides a signal that more quickly responds to changes in the chemical make-up of the exhaust gas. However, while the dynamic response is faster than that provided by the downstream sensor 36, the upstream sensor 38 is not "protected" by the catalytic converter 32 and may produce signals subject to offset errors.

Accordingly, the control assembly 40 receives signals from both upstream and downstream sensors 38, 36. When there is a substantial change in the exhaust gas composition, both the upstream and downstream sensors 36, 38 tend to change the oxygen level signals they provide. In response to such dynamic signals, the control assembly 40 promptly adjusts the mixture control signal so that it substantially corresponds to the changed signal from the upstream sensor 38. As the downstream sensor 36 then reacts to the change in composition of the exhaust gas, the control assembly 40 may then further modify the mixture control signal supplied to the air-fuel distributor 34 in accordance with the downstream sensor's signal. As both the upstream and downstream sensor signals substantially reach a steady state condition, the controller 40 "tunes" the mixture control signal so that it substantially corresponds to the slower, but generally more accurate, signal provided by the downstream sensor 36.

Thus, in many cases, the downstream sensor 36 provides a more precise representation of the exhaust gas oxygen concentration (albeit with a slower response time) than the upstream sensor 38. However, variations in the temperature of the downstream sensor 36 may substantially affect the accuracy of the signal it provides. Accordingly, the heater 48 warms the sensor 36 and reduces effects of exhaust gas temperature variations. A heater may also be positioned to warm the upstream sensor 38, as required.

The leads 50, 52 deliver, from the control assembly 40 to the heater 48, an electric power signal to activate the heater 48. The control assembly 40 selectively activates the heater 48 of the sensor 36 to maintain the sensor 42 within a proper temperature range.

Figure 4:
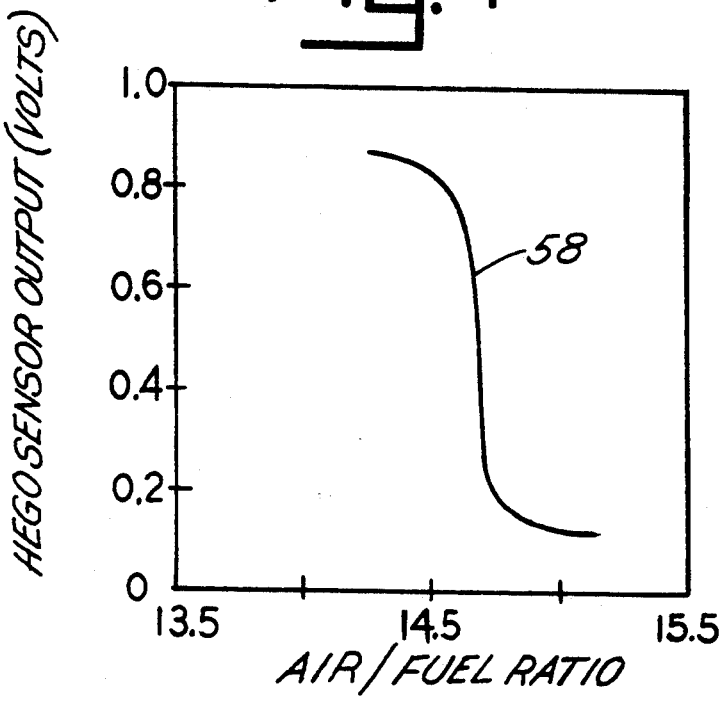
FIG. 4 is a graph showing the experimentally measured output voltage of the HEGO sensor assembly shown in FIG. 1 as a function of the engine's air-fuel ratio.

The graph 58 of FIG. 4 shows a typical oxygen level signal provided by the HEGO sensor 38 as a function of the air-fuel ratio being delivered by the system 26 to the engine 22. The sensor 36 provides a substantially high voltage, in excess of 0.8 volts, when the air-fuel ratio is below 14.5, but provides a low voltage, substantially below 0.2 volts, when the air-fuel ratio is above 15. Thus, a relatively small change in air-fuel mixture causes a dramatic change in the sensor voltage (or the "oxygen level signal").

Often, the output of the sensor 36 is processed by a comparator within the controller 40 before being passed to the air-fuel delivery system 34. The signal provided by the comparator may be either (1) a large value (or "one") or (2) a low value (or "zero"), depending on whether the HEGO sensor voltage is greater or less than a reference "st point" (or "control point") voltage, such as, for example, 0.45 volt.

Many air-fuel control systems using an EGO or HEGO sensor as the feedback element have a tendency to control to an air-fuel ratio that is too high ("lean") when the temperature of the exhaust gas is too low. Conversely, the controlled air-fuel ratio may be too low (too "rich") when the sensor has been heated above its operating range.

Figure 5:
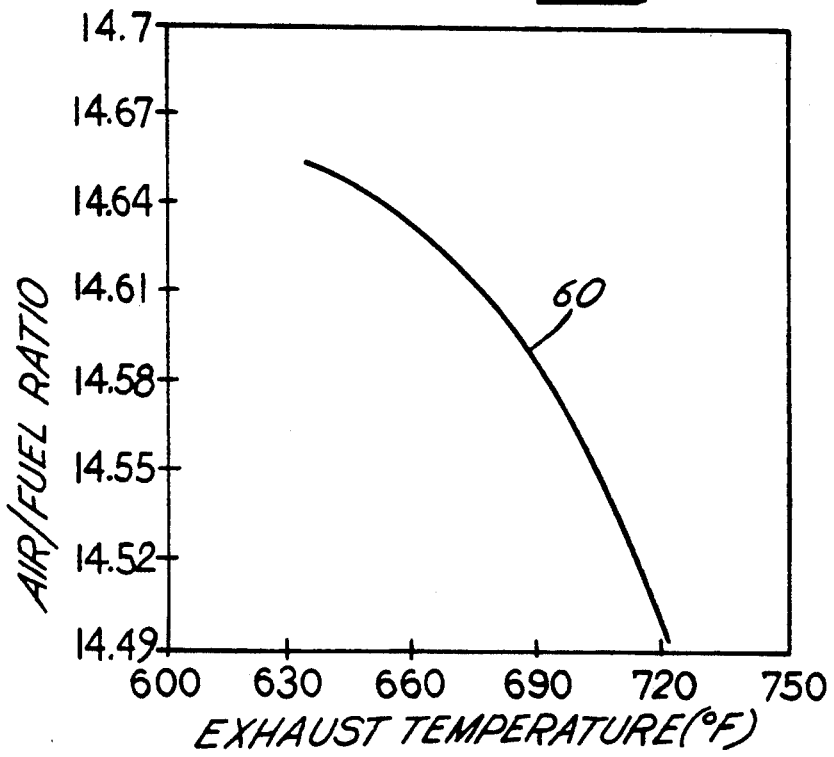
FIG. 5 is a graph showing the experimentally measured control points of the HEGO sensor assembly shown in FIG. 1 as a function of the exhaust gas temperature.

For example, the graph 60 of FIG. 5 shows experimentally derived data regarding how the sensor's closed-loop control point varies as a function of the exhaust gas temperature. An exhaust temperature change of less than 100° F. causes the control point to change well over 0.1. Thus, for example, the oxygen sensor 36 and control assembly 40 may regulate the air-fuel ratio of the engine 22 to 14.65 when the exhaust temperature is approximately 640° F., but to an air-fuel ratio of 14.56 when the exhaust temperature is approximately 700° F.

Figure 6:
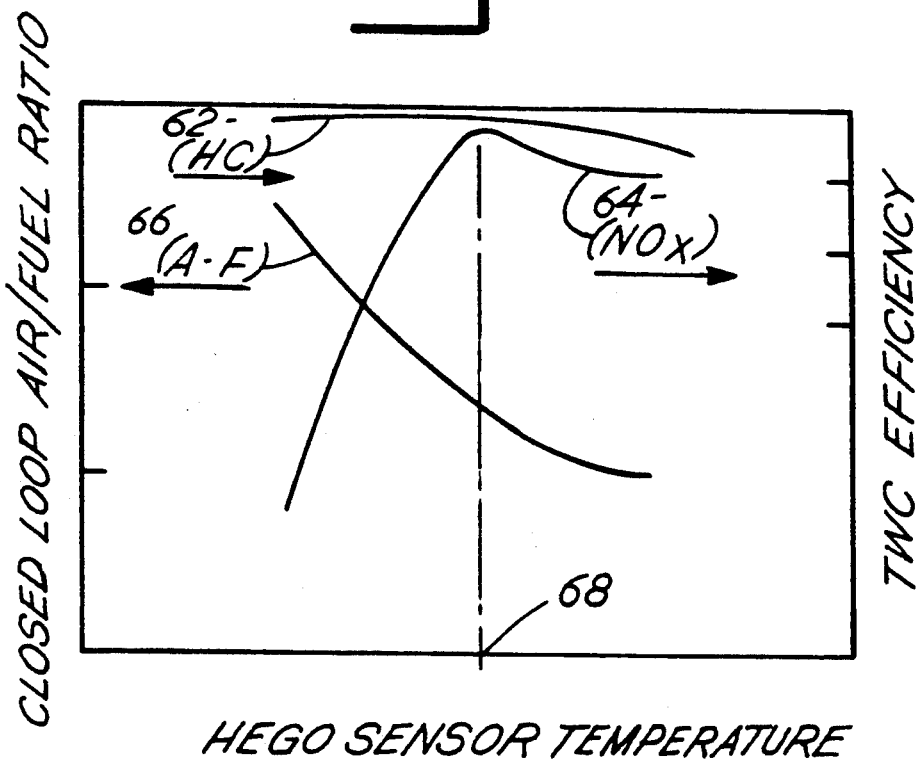
FIG. 6 is a graph showing the experimentally measured changes in the conversion efficiency of the catalytic converter shown in FIG. 1 and the engine's air-fuel ratio as a function of the HEGO sensor temperature.

The change in set point—the designation by a oxygen sensor assembly of what air-fuel mixture is appropriate—may have a substantial effect on the operation of the engine 22. FIG. 6 shows experimentally derived data for a catalytic converter's efficiency in converting hydrocarbons and oxides of nitrogen and the closed-loop air-fuel ration as a function of temperature. Lone 62 shows the converter's efficiency in converting hydrocarbons, and line 64 shows the converter's efficiency in converting oxides of nitrogen, as the temperature and, consequently, the air-fuel ratio 66 vary. Only the air-fuel mixture near a particular balance 68 point provides the substantially optimal efficiency in reducing hydrocarbons and oxides of nitrogen.

Thus, precisely maintaining the air-fuel mixture is important to keep the converter 32 operating efficiently. Providing a correct oxygen level concentration signal to system 34 is important, so that the correct air-fuel ratio can be maintained. The oxygen level signal provided by the oxygen sensor 36 can have substantial impact on the air-fuel ratio and thus on the operation of the fuel distribution system 34 and the efficiency of the catalytic converter 32.

Figure 7:
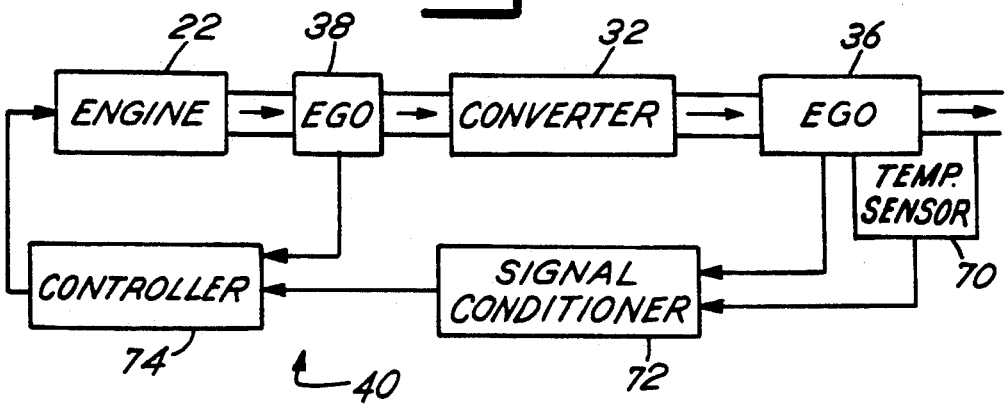
FIG. 7 is a schematic diagram of a preferred embodiment of the invention shown in FIG. 1.

As shown in FIGS. 1 and 7, a preferred embodiment of the present invention includes a temperature sensor 70 inside the downstream sensor 36. The temperature sensor 70 provides a temperature level signal to the control assembly 40 via one or more leads 71. The control assembly 40 includes both a signal conditioner 72 and a microprocessor-based controller 74. In the preferred embodiment, the signal condition function is incorporated in the microprocessor. For purposes of illustrating the present invention, however, the signal conditioner 72 is shown as distinct from the microprocessor-based controller 74.

The signal conditioner 72 receives inputs from the downstream sensor 36 and the temperature sensor 70. The signal conditioner 72 adjusts the oxygen level signal from the sensor 36 as a function of the temperature level signal received from the temperature sensor 70.

The signal conditioner 72 responsively provides a conditioned output to the controller 74. The signal conditioner 72 adjusts, or conditions, the oxygen level signal from the downstream sensor 36 before it is passed on to the controller 74. The controller 74 then provides a mixture control signal, or "controlled signal," to the engine 22, which uses the signal to influence the operating parameters of the engine 22, such as the air-fuel mixture. The controller 74 receives the conditioned output of the signal conditioner 72, as well as an oxygen level signal from the upstream sensor 38. In another embodiment, the controller 74 may also receive an input representing the temperature of the upstream sensor 38.

Figure 8:
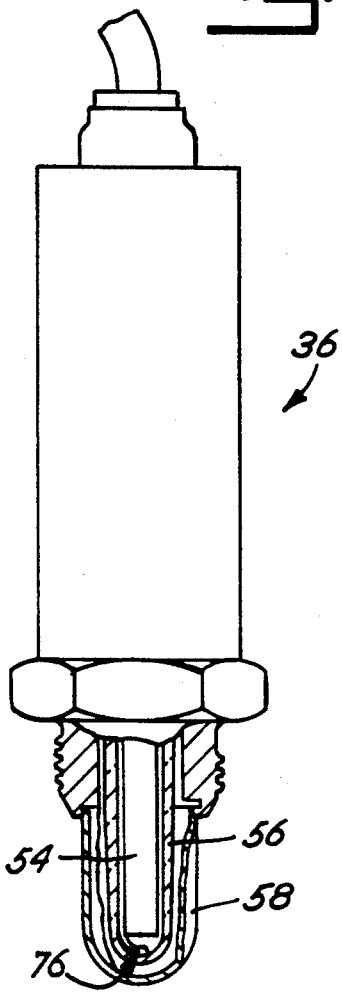
FIG. 8 is a partial cross-sectional view of a combined HEGO sensor and temperature sensor that may be used with the invention shown in FIG. 7.

FIG. 8 shows one embodiment of the temperature sensor 70. The temperature sensor 70 consists of a thermocouple 76 located adjacent the sensor tip 56, inside the canister 58. Under this arrangement, the thermocouple 76 provides an accurate temperature level signal to the signal conditioner 72 regarding the operating temperature of the adjacent sensing tip 56.

Figure 9:
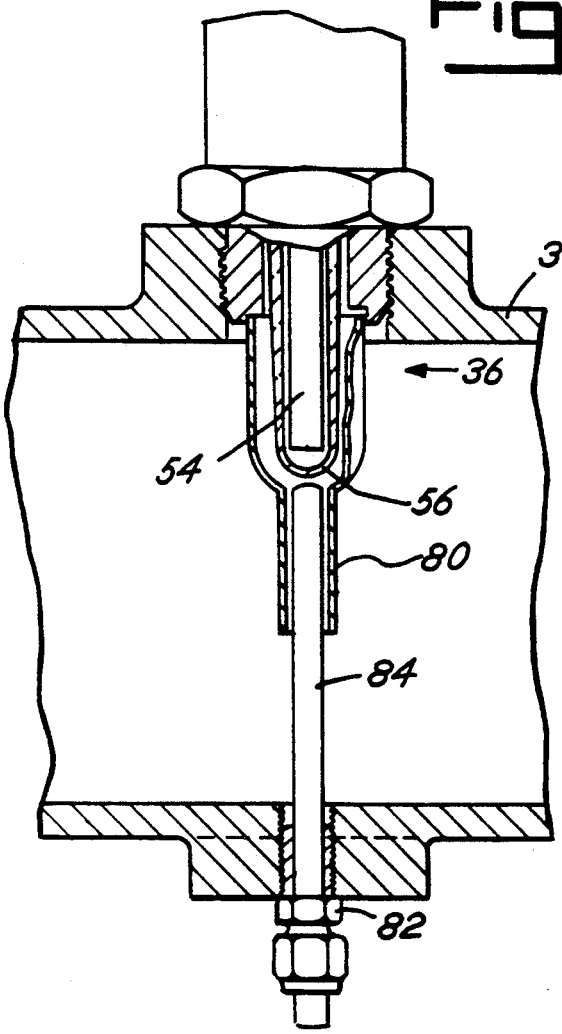
FIG. 9 is a partial cross-sectional view of an alternative HEGO sensor and temperature sensor that may be used with the invention shown in FIG. 7.

Another embodiment of the temperature sensor 70 is shown in FIG. 9. The temperature sensor 70 consists of an extension tube 80 which mounts over the tip of the sensor 36, a compression fitting 82 in the exhaust pipe 30, and an elongated thermocouple 84, which fits between the extension tube 80 and fitting 82. Again, the thermocouple 84 provides an electrical output that depends on the surrounding temperature. The compression fitting 82 and tube 80 hold the thermocouple 84 in place in the exhaust pipe 30, adjacent the tip 56 of the sensor 36.

Figure 10:
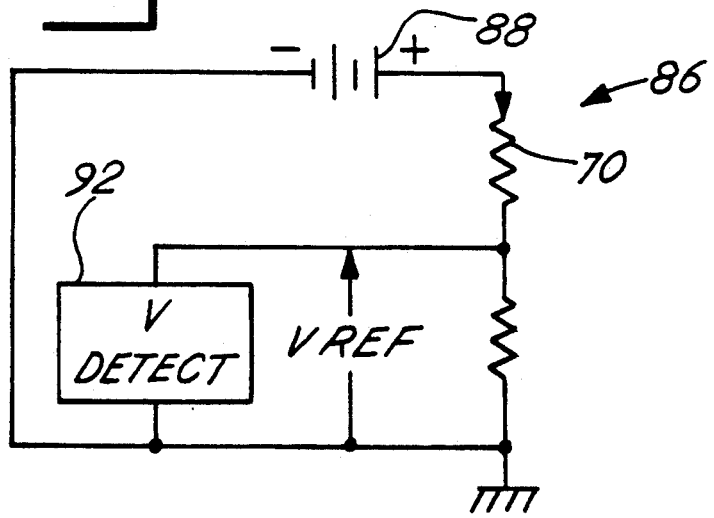
FIG. 10 is a schematic diagram of a temperature sensor that may be used with the invention shown in FIG. 7.

Yet another apparatus 86 to detect the temperature adjacent the sensor 36 is shown in FIG. 10. The apparatus 86 consists of a known voltage source, such as the automotive vehicle battery 88, connected in series with the heater 70 and a known resistance 90, together with a voltage detector 92. The heater 70 and known resistance 90 thus divide the voltage provided by the automotive battery 88. The voltage measured by the detector 92 across the known resistance 90 is substantially directly proportional to the resistance of the heater 70. The resistance of the heater 70 has been found to reflect the temperature of the sensor 36. Accordingly, the conditioner 72 may receive a signal from the voltage detector 92 that is indicative of the temperature of the sensor 36. Notably, however, if the vehicle battery 88 is chosen as the voltage source, the temperature associated with a particular resistance is a function of the battery voltage.

In yet another embodiment of the present invention, rather than using a direct measurement of the temperature of the sensor 36, the controller 74 receives inputs regarding engine variables, such as speed and load. From this, and the length of time that the engine 22 has been in operation, a microprocessor assembly within the controller 74 may "map" the inputs regarding the experienced engine parameters with tables in its memory to estimate the expected temperature of the sensor 36.

Figure 11:
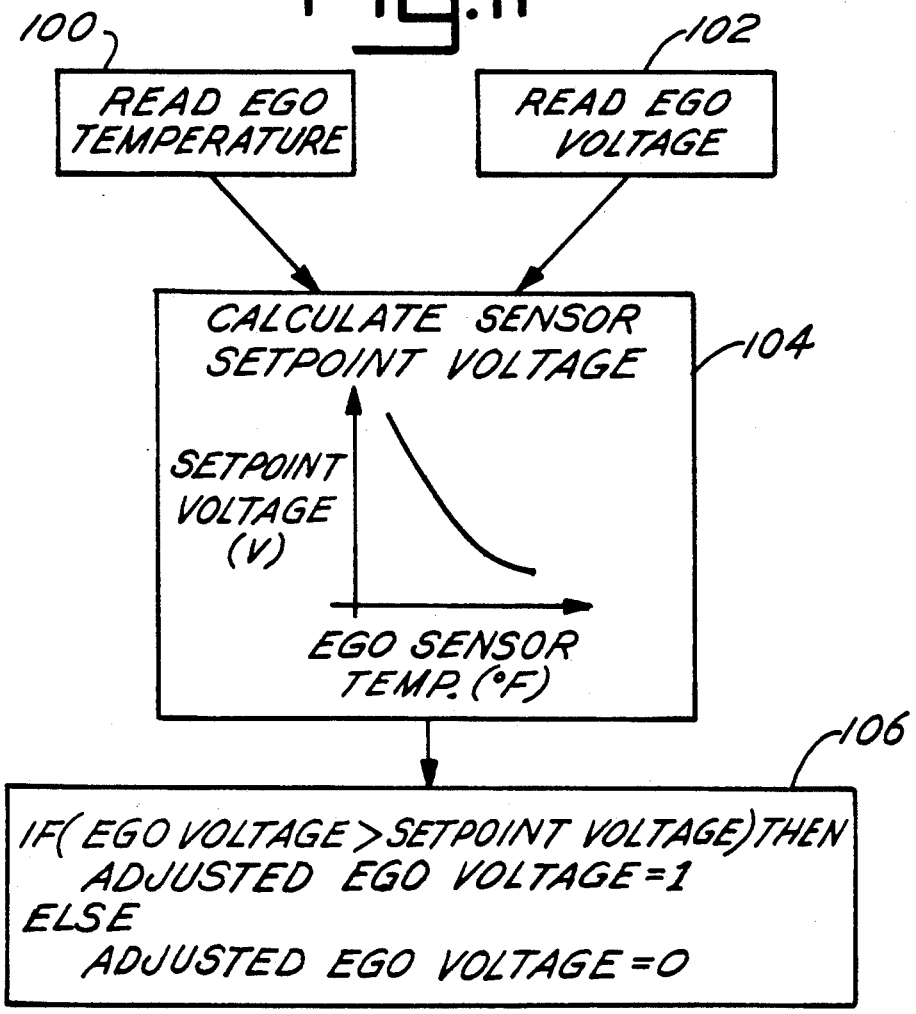
FIG. 11 is a flow chart showing the process that may be used by the signal conditioner shown in FIG. 7.
Figure 12:
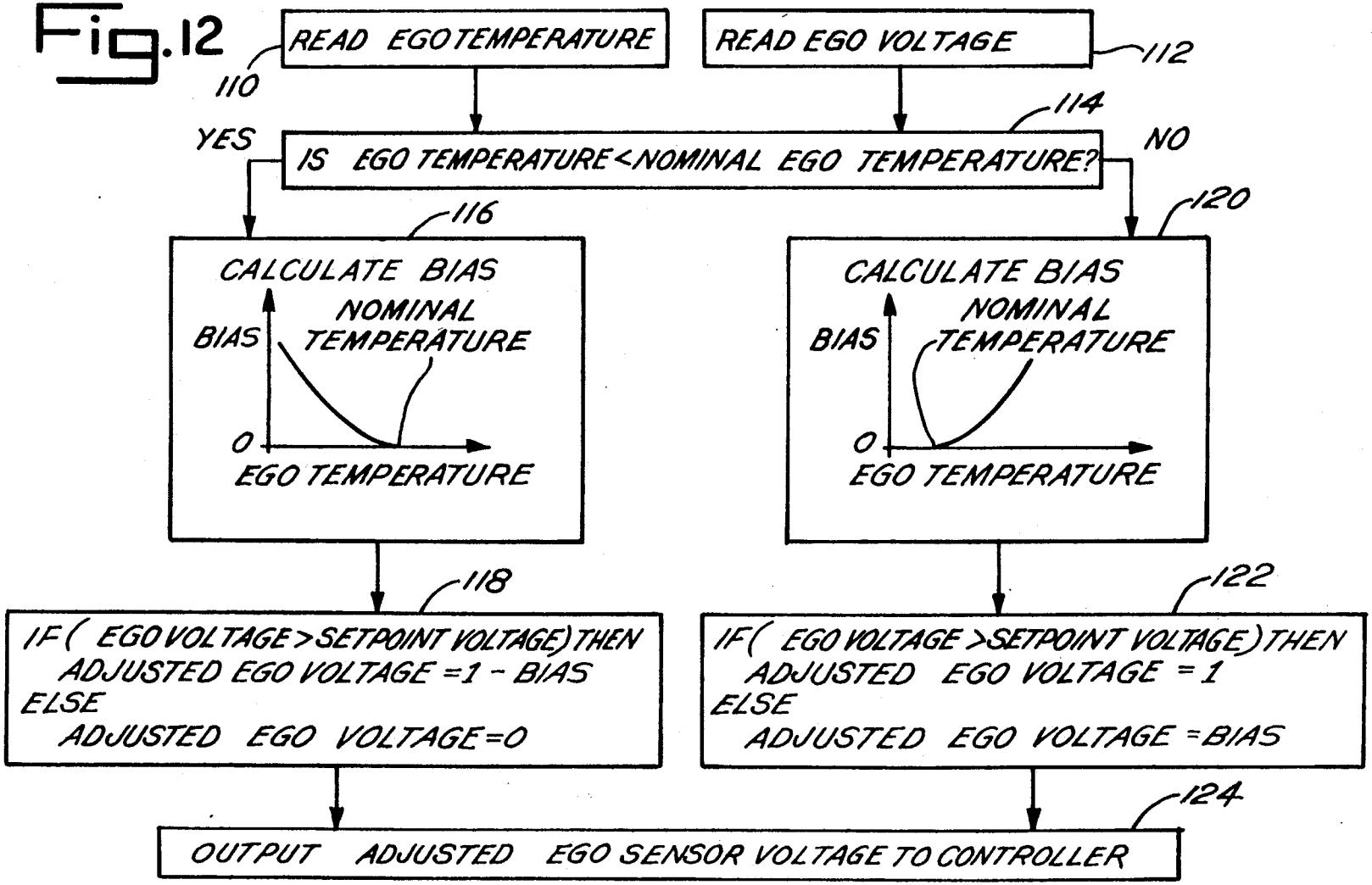
FIG. 12 is a flow chart showing an alternative process that may be used by the signal conditioner shown in FIG. 7.

One embodiment of the process used by the signal conditioner 72 to influence the set point of the downstream sensor 36 is shown in FIG. 11. At steps 100 and 102, the signal conditioner 72 reads both the sensor temperature and the sensor voltage. At step 104, the set point is determined as a function of the oxygen level signal provided by the sensor 36 and the temperature sensed by the temperature sensor 70. As shown in FIG. 12, for a lower EGO temperature, a higher set point voltage for the sensor is established. Conversely, for a higher temperature, a lower set point voltage is established.

Next, at step 106, the HEGO voltage actually measured is compared with the set point calculated in step 104. If the sensor voltage is greater than the calculated set point voltage, then the conditioned signal issued by the signal conditioner 72 is set to a high (or "one") level. Otherwise, if the sensor voltage is below the calculated set point voltage, the conditioned signal is established as a low (or "zero") signal.

The conditioned signal is a voltage (or digital equivalent) ranging in value from zero to one and may be expected to maintain an average value equal to a reference, or set point, voltage for operation at "stoichiometry." Consequently, another method of adjusting the sensor signal to account for the effect of temperature is to bias the average value of the signal being fed to the controller 74 by the signal conditioner 72. This may be accomplished by keeping a constant value for the reference, or set point, voltage, but assigning values to the conditioned signals supplied by the conditioner 72 over a range of zero to one as a function of the temperature.

Thus, for example, by assigning a value less than one to the conditioned signal for a sensor voltage that is greater than the set point voltage, an average conditioned signal for a "high" oxygen level signal will be less than one, causing a "rich" correction. Conversely, a "lean" correction can be generated by making the conditioned signal greater than zero when the oxygen level signal from sensor 36 is less than the set point voltage.

Accordingly, an alternative process that may be followed by the signal conditioner 72 is shown in FIG. 12. At steps 110 and 112, the signal conditioner 72 again reads the sensor voltage and the sensor temperature. At step 114, the signal conditioner 72 determines whether the EGO temperature is less than a predetermined nominal temperature. The nominal temperature may be set, for example, in the mid-range of the normal operating temperature of the EGO sensor.

If the temperature is less than the nominal temperature, the signal conditioner 72, at step 116, determines a first bias. The bias is higher for a lower temperature. At step 118, the oxygen level signal from the sensor 36 is adjusted. The conditioned signal is set to be one minus the bias voltage calculated in step 116, if the oxygen level signal is above the set point. Otherwise, the conditioned signal is established at zero.

Alternatively, if, at step 114, the EGO temperature was measured to be equal or greater than the nominal EGO temperature, at step 120, a bias is again calculated. The bias is larger the higher the EGO temperature is above the nominal point. At step 122, if the oxygen level signal is greater than the set point, the conditioned signal is determined to be one. Otherwise, the conditioned signal is determined only to be the bias voltage. Then, regardless of what conditioned signal is determined at steps 118 or 122, the calculated sensor voltage is output to the controller 74 at step 124.

Figure 13:
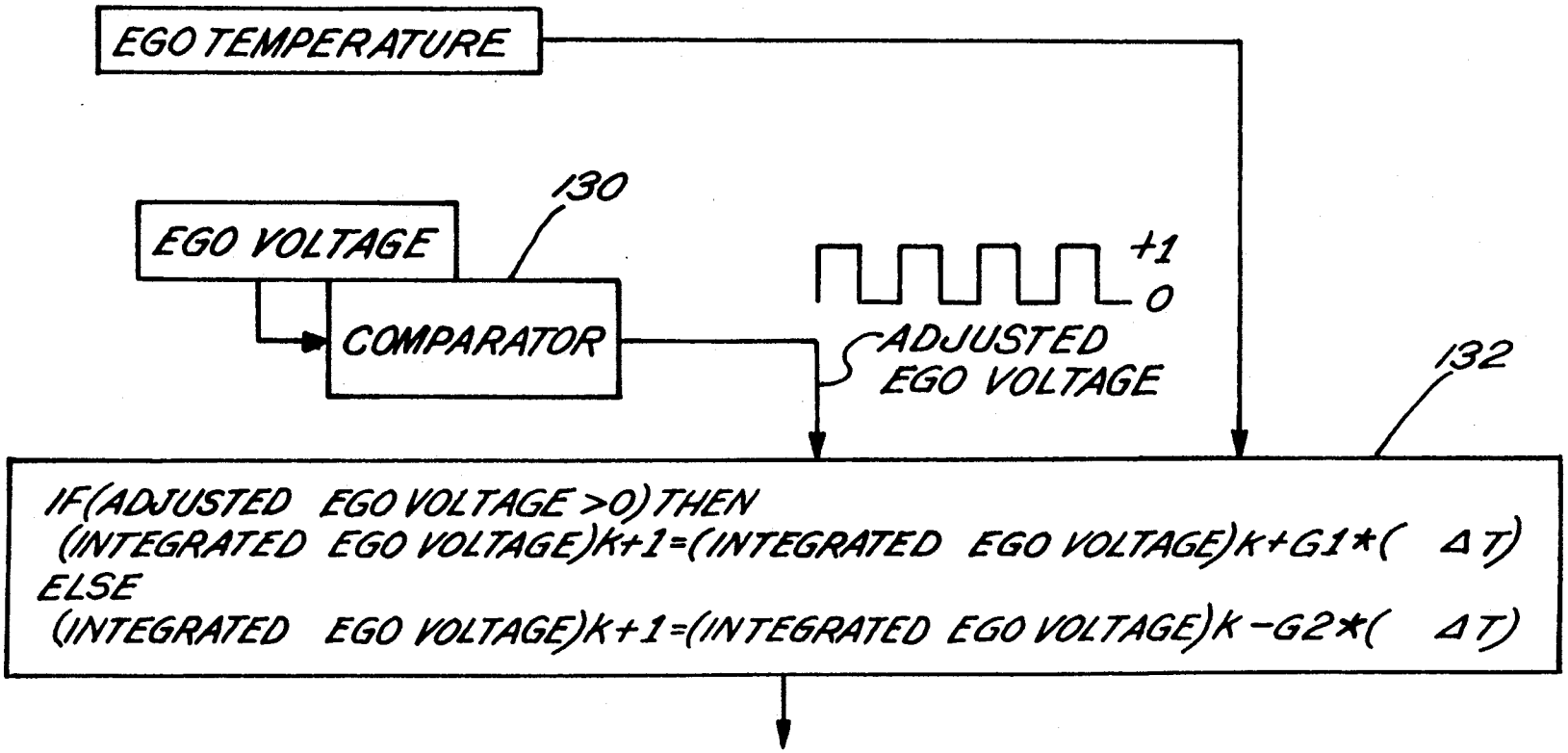
FIG. 13 is a flow chart showing a second alternative process that may be used by the signal conditioner shown in FIG. 7.

Another process by which the signal conditioner 72 may achieve the same, general effect is shown in FIG. 13. At step 130, the oxygen level signal from the sensor 36 is compared with an established set point voltage to achieve either a high ("one") or low ("zero") output. The output of the comparison is then biased, at step 132, by varying the positive and negative integral gains as a function of temperature. Thus, by increasing the positive gain relative to the negative gain, a positive bias in the average values issued by the signal conditioner 72 is achieved. Conversely, a negative bias in the average value issued by the signal conditioner 72 is achieved by increasing the negative gain relative to the positive gain.

Figure 14:
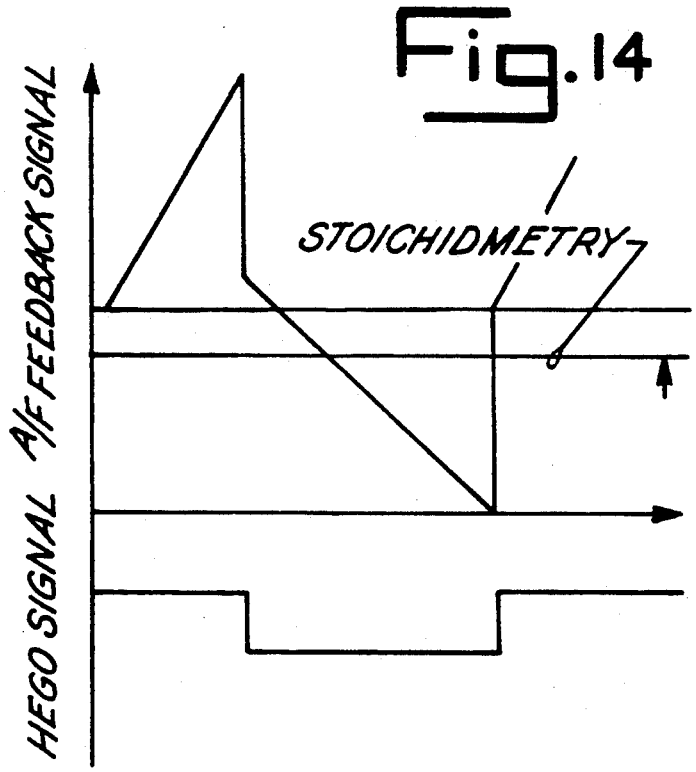
FIG. 14 is a series of two graphs showing the output of a HEGO sensor and signal conditioner using the process shown in FIG. 13, when the temperature of the HEGO sensor is above a predetermined standard.

In FIG. 13, the current conditioned signal is denoted as a function of "K+1" and the previous conditioned signal is denoted as a function of "K." $G_1$ and $G_2$ are the rising and falling slope constants, and $\Delta T$ is the time sample interval of a microprocessor in the signal conditioner 72. The output of the signal conditioner 72 relative to the oxygen level signal where a positive bias is required (because of a high temperature for the sensor 36) is shown in FIG. 14.

Figure 15:
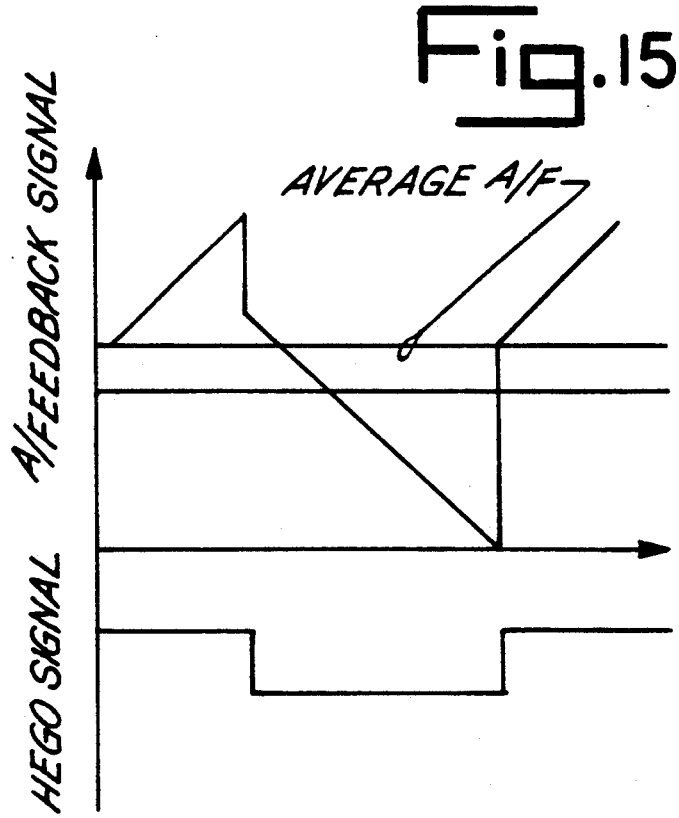
FIG. 15 is a series of two graphs showing the output of a HEGO sensor and signal conditioner using the process shown in FIG. 13, when the temperature of the HEGO sensor is below a predetermined standard.

The output of the signal conditioner 72 relative to the oxygen level signal where a negative bias is required (because of a low temperature for the sensor 36) is shown in FIG. 15. In contrast to the method of biasing the signal used for FIG. 14, however, the graph of FIG. 15 is realized by providing different up/down proportional gains.

Preferred embodiments of the present invention have been described herein. It is to be understood, however, that changes and modifications can be made without departing from the true scope and spirit of the present invention. This true scope and spirit are defined by the following claims and their equivalents, to be interpreted in light of the foregoing specification.

We claim:

1. An exhaust gas sensor system for an internal combustion engine having an exhaust conduit and a catalytic converter on said conduit, said system comprising, in combination:

an exhaust gas oxygen sensor, on said exhaust conduit downstream of said converter, for providing an oxygen level signal;

a temperature sensor for sensing a temperature of said exhaust gas sensor and responsively issuing a temperature level signal; and a signal conditioner for receiving said temperature level signal and oxygen level signal and responsively providing a conditioned output, said signal conditioner providing a high signal upon determining that said oxygen level signal is above a set point and a low signal upon determining that said oxygen level signal is below a set point, said signal conditioner changing said set point in a first direction as said temperature of said exhaust gas oxygen sensor decreases and changing said set point in a second direction as said temperature of said exhaust gas oxygen sensor increases, whereby said conditioned output may be used by said engine to adjust operating parameters.

2. An assembly as claimed in claim 1 wherein said temperature sensor is located within said exhaust gas oxygen sensor.

3. An assembly as claimed in claim 1 wherein said temperature sensor is attached to said exhaust gas oxygen sensor.

4. An assembly as claimed in claim 1 further comprising a heater for said exhaust gas oxygen sensor, said heater exhibiting an impedance, and wherein said temperature sensor comprises an impedance sensor interconnected to said heater.

5. An assembly as claimed in claim 1 wherein said signal conditioner raises said set point as said temperature of said exhaust gas oxygen sensor decreases and lowers said set point as said temperature of said exhaust gas oxygen sensor increases.

6. An exhaust gas sensor system for an internal combustion engine having an exhaust conduit and a catalytic converter on said conduit, said system comprising, in combination:

an exhaust gas oxygen sensor, on said exhaust conduit downstream of said converter, for providing an oxygen level signal;

temperature sensor for sensing a temperature of said exhaust gas sensor and responsively issuing a temperature level signal; and a signal conditioner for receiving said temperature level signal and oxygen level signal and responsively providing a conditioned output, said signal conditioner adjusting said oxygen level signal as a function of said temperature level signal, said signal conditioner increasing said conditioned output at a first rate when said oxygen level signal is above a predetermined set point and said temperature of said exhaust gas oxygen sensor is above a predetermined standard, said signal conditioner decreasing said conditioned output at a second rate when said oxygen level signal is below a predetermined set point and said temperature of said exhaust gas oxygen sensor is above said predetermined standard, whereby said conditioned output may be used by said engine to adjust operating parameters.

7. An assembly as claimed in claim 6 wherein said first rate is larger than said second rate, whereby said signal conditioner generates a positive bias in an average value of said conditioned signal when said temperature is above said predetermined standard.

8. A process for correcting the output of an exhaust gas oxygen sensor to produce a conditioned signal, said exhaust gas oxygen sensor being interconnected to an exhaust conduit of an internal combustion engine downstream of a catalytic converter and including a heater that exhibits an impedance, comprising the steps:

receiving an oxygen level signal from said oxygen sensor;

detecting the temperature associated with said oxygen sensor by measuring an impedance of said exhaust gas oxygen heater; and adjusting said oxygen level signal in response to said temperature level signal by providing a high conditioned signal in response to an oxygen level signal above a predetermined set point and a low conditioned signal in response to an oxygen level signal below a predetermined set point, and increasing said predetermined set point when said temperature is above a predetermined standard and decreasing said predetermined set point when said temperature is below said predetermined standard.

9. A method as claimed in claim 8 further comprising the steps of increasing said conditioned signal at a first rate when said oxygen level is above said predetermined set point and said temperature is above said predetermined standard and decreasing said conditioned signal at a second rate when said oxygen level is below said predetermined set point and said temperature is above said predetermined standard, said first rate being greater than said second rate.

* * * * *